US011428407B2

(12) United States Patent
Feldman et al.

(10) Patent No.: US 11,428,407 B2
(45) Date of Patent: Aug. 30, 2022

(54) COMBUSTION AIR PROVING APPARATUS WITH BURNER CUT-OFF CAPABILITY AND METHOD OF PERFORMING THE SAME

(71) Applicant: Cowles Operating Company, North Haven, CT (US)

(72) Inventors: Charles Feldman, Belchertown, MA (US); John Dunleavey, Oxford, CT (US)

(73) Assignee: Cowles Operating Company, North Haven, CT (US)

( * ) Notice: Subject to any disclaimer, the term of this patent is extended or adjusted under 35 U.S.C. 154(b) by 275 days.

(21) Appl. No.: 16/583,893

(22) Filed: Sep. 26, 2019

(65) Prior Publication Data

US 2020/0096196 A1 Mar. 26, 2020

Related U.S. Application Data

(60) Provisional application No. 62/736,737, filed on Sep. 26, 2018.

(51) Int. Cl.

| | |
|---|---|
| ***F23N 5/18*** | (2006.01) |
| ***F23N 3/00*** | (2006.01) |
| ***F23N 5/24*** | (2006.01) |

(52) U.S. Cl.

CPC ..... *F23N 5/18* (2013.01); *F23N 3/005* (2013.01); *F23N 5/245* (2013.01); (Continued)

(58) Field of Classification Search

CPC . F23N 5/18; F23N 5/242; F23N 5/245; F23N 5/247; F23N 2227/32;

(Continued)

(56) References Cited

U.S. PATENT DOCUMENTS

| | | | |
|---|---|---|---|
| 1,947,725 | A | 2/1934 | Macarthur et al. |
| 3,119,266 | A | 1/1964 | Atkinson |

(Continued)

FOREIGN PATENT DOCUMENTS

| | | | |
|---|---|---|---|
| EP | 0449112 | A1 | 3/1990 |
| EP | 0769662 | A1 | 10/1996 |

(Continued)

*Primary Examiner* — Steven B McAllister
*Assistant Examiner* — Daniel E. Namay
(74) *Attorney, Agent, or Firm* — DeLio Peterson & Curcio LLC; Robert Curcio

(57) ABSTRACT

A combustion air proving (CAP) system for a burner assembly having a burner for providing heated air to a location, a controller, and a back plate, where outside air is fed to the burner via a conduit. The CAP system, is connected to an inlet of the system. An outlet of the system is connected to the burner via the back plate. A damper within the system is translatable between open and closed positions for allowing and blocking air flow, respectively. A sensor measures an air flow parameter of air flow to the burner. The sensor communicates with the controller, which shuts down the burner if the parameter measured by the sensor meets a predetermined threshold value. An assembly installer may test for proper sensor and controller functions by translating the damper to the closed position and blocking outside air flow.

22 Claims, 11 Drawing Sheets

(52) U.S. Cl.
CPC .... *F23N 2005/181* (2013.01); *F23N 2225/06* (2020.01); *F23N 2227/02* (2020.01); *F23N 2227/32* (2020.01); *F23N 2233/06* (2020.01); *F23N 2235/02* (2020.01); *F23N 2237/00* (2020.01)

(58) Field of Classification Search
CPC ..... F23N 2227/02; F23N 2225/06; F23N 2233/06; F23N 2237/00; F23N 2235/02; F23N 2005/181; F23N 2005/182; F23N 5/24; F23N 3/00; F23N 3/02; F23C 7/008; F23C 7/00; F23D 14/72; F23D 2209/00
USPC ..... 431/6, 14
See application file for complete search history.

(56) References Cited

U.S. PATENT DOCUMENTS 3,243,116 A * 3/1966 Dijt ..... F23N 5/003 431/12
3,335,334 A 8/1967 Albisser
4,019,067 A 4/1977 Gladstone
4,027,172 A 5/1977 Hamelink
4,034,911 A 7/1977 Baysinger et al.
4,110,740 A 8/1978 Akita et al.
4,163,391 A 8/1979 Bezard et al.
4,179,309 A 12/1979 Hance
4,259,982 A 4/1981 Bartels
4,263,587 A 4/1981 John
4,289,271 A * 9/1981 Barth ..... F23L 13/02 236/1 G
4,290,552 A * 9/1981 Prikkel, III ..... F23N 3/047 126/285 B
4,360,738 A 11/1982 Bartels
4,390,793 A 6/1983 John
4,433,810 A 2/1984 Gottlieb
4,467,178 A 8/1984 Swindle
4,482,891 A 11/1984 Spencer
4,507,521 A 3/1985 Goellner
4,513,616 A 4/1985 Bezard et al.
4,522,333 A 6/1985 Balu
4,565,930 A 1/1986 Bartels
4,646,569 A 3/1987 Cosser
4,685,616 A 8/1987 Stein
4,716,858 A 1/1988 Bartels
4,723,122 A 2/1988 Maltby et al.
4,731,730 A 3/1988 Hedrick et al.
4,761,638 A 8/1988 Lozano
4,841,770 A 6/1989 Davies
4,902,962 A 2/1990 Ishikawa
4,903,530 A 2/1990 Hull
4,952,779 A 8/1990 Eaton-Williams
5,110,418 A 5/1992 Garrison et al.
5,220,514 A 6/1993 John
5,224,445 A 7/1993 Gilbert, Sr.
5,440,668 A 8/1995 Jones
5,520,533 A * 5/1996 Vrolijk ..... F23N 1/027 431/90
5,692,676 A 12/1997 Walker
5,739,504 A 4/1998 Lyons et al.
5,799,648 A * 9/1998 Oglesby ..... G05D 23/024 126/414
5,894,384 A 4/1999 Funayama et al.
5,920,447 A 7/1999 Sakata et al.
6,039,261 A * 3/2000 Pavese ..... F23N 5/006 236/14
6,772,753 B2 * 8/2004 Roesler ..... F26B 25/009 126/312
7,093,611 B2 8/2006 Murray
7,101,172 B2 * 9/2006 Jaeschke ..... F23N 3/08 431/19
7,735,743 B2 * 6/2010 Jaeschke ..... F23N 5/18 236/11
8,294,893 B2 * 10/2012 Yamauchi ..... G01N 21/714 356/315
9,416,981 B2 8/2016 Murray
9,851,111 B1 12/2017 Lyons
10,704,942 B2 * 7/2020 Kitano ..... G01F 1/66
10,782,022 B2 * 9/2020 Pancolini ..... F23N 5/02
2004/0020485 A1 * 2/2004 Roesler ..... F26B 23/02 126/312
2004/0043345 A1 * 3/2004 Jaeschke ..... F23N 3/08 431/18
2007/0003891 A1 * 1/2007 Jaeschke ..... F23N 5/18 431/19
2010/0134795 A1 * 6/2010 Yamauchi ..... F23N 5/242 356/315
2012/0107753 A1 * 5/2012 Kemp ..... F23N 5/184 431/12
2013/0291770 A1 * 11/2013 Kashima ..... F23N 3/002 110/189
2015/0300640 A1 * 10/2015 Smith ..... F23N 3/082 431/12
2016/0061445 A1 * 3/2016 Kim ..... F23D 14/04 431/354
2017/0167726 A1 * 6/2017 Pancolini ..... F23N 1/022
2017/0299179 A1 * 10/2017 Yang ..... F23N 5/247
2017/0328559 A1 * 11/2017 Doura ..... F23D 14/60
2018/0094809 A1 * 4/2018 Lochschmied ..... F23N 1/025
2018/0274782 A1 * 9/2018 Schmiederer ..... F23N 1/022
2019/0003866 A1 * 1/2019 Kitano ..... G01F 1/74
2019/0024891 A1 * 1/2019 Kitano ..... G01F 15/00
2021/0291127 A1 * 9/2021 Hishikawa ..... F23D 14/64

FOREIGN PATENT DOCUMENTS

JP S553600 A 1/1980
JP 59074426 A * 4/1984 ..... F23N 5/187
JP S63129221 A 11/1986
JP S62238902 A 10/1987
JP H01179804 A 12/1987
JP 2017125759 A * 7/2017 ..... G01F 15/06
WO WO-9906768 A1 * 2/1999 ..... F23N 5/184

* cited by examiner

DETAIL A

DETAIL C

DETAIL D

SECTION E-E

DETAIL F

COMBUSTION AIR PROVING APPARATUS WITH BURNER CUT-OFF CAPABILITY AND METHOD OF PERFORMING THE SAME

BACKGROUND OF THE INVENTION

1. Field of the Invention

The present invention relates to an apparatus and method for ensuring combustion air is supplied to an oil or gas burner on a heating appliance.

2. Description of Related Art

Present day fuel oil and gas burners are used to provide heat to appliances (e.g. furnaces, boilers, or water heaters) in buildings located in colder regions throughout the world. Many of these appliances use pressure-fired burners, which spray a pressurized mist of fuel oil, natural gas, propane, biofuel, etc. (collectively hereinafter "fuel"), into a combustion chamber that is then ignited by a spark or pilot. These fuel burners require an ample supply of combustion air to operate correctly and safely.

Typically, a fan pushes combustion air through the burners air tube to the location where the fuel is introduced. Fuel is mixed with the combustion air when the air reaches the end of the air tube. An igniter burns the pressurized fuel (combined with the air) and begins the combustion/heating process. The air blown into the air tube can be room air, or air from outside the dwelling.

Fuel-fired furnaces and boilers require an adequate supply of air to ensure proper and safe burning of the fuel. An insufficient supply of combustion air can result in unstable and/or poor combustion quality. This can result in the burner shutting down and thus failing to provide heat. Alternately, the burner may continue to operate with poor combustion characteristics which can lead to soot build up and clogging of the appliance, and increased levels of pollutants (e.g. carbon monoxide).

Fuel burners on heating appliances located in smaller spaces may not have an adequate combustion air supply. Additionally, newer, more fuel-efficient houses are built with less air infiltration than houses built in decades past. These newer houses may become depressurized by factors such as: exhaust fans, clothes dryers, fireplaces, and kitchen exhaust hoods. This depressurization thus reduces the combustion air available to the fuel burners.

Thus, in these tight, restricted environments where combustion air can be limited, it is preferred and often required by building codes to bring the air in from outside the boiler room, and more preferred to bring the air in from outside the building where the heating appliance is located.

The need for a permanent source of combustion air is necessary to ensure the combustion performance of a burner. Temporary air intakes such as open boiler room windows can be closed, which cuts off the burner's air supply.

When the combustion air supply is closed off, the fire starts to smoke as the air supply is exhausted. Incomplete combustion occurs and excessive pollutants are generated. The fire then goes out or continues to burn the fuel rich, often before the flame detection system can act to close the fuel safety shutoff valve(s).

Codes have been created to ensure that combustion equipment has an adequate supply of combustion air. In installations where the combustion air is deemed inadequate, these codes call for multiple openings to be made to communicate outside air, or air from larger spaces within the dwelling, with the space in which the combustion appliance is located. Some of these codes allow for fan units which force outside air into the space when the combustion equipment is operating. These units are electrically interlocked with the burner and are designed to shut the burner off if they detect that the supply of outside air is blocked. While effective in supplying needed combustion air, these solutions have proven to be expensive, difficult to install, and often result in complaints of cold basements during the winter months. In addition, for burners that operate in the summer months for heating water, the warm humid air taken from the outside often condenses on cooler basement surfaces, thus causing rust and mold to develop.

Enclosing the fuel burner in a housing and supplying outside air directly into the housing is another method for providing combustion air for a fuel burner. Air intake systems of this type have been available for years but are largely not recognized by building codes on the basis that they could become blocked and thus preventing combustion air from reaching the burner.

SUMMARY OF THE INVENTION

Bearing in mind the problems and deficiencies of the prior art, it is therefore an object of the present invention to provide a method and/or apparatus for supplying outside air to a fuel burner that will contain the air to the immediate proximity of the burner.

It is another object of the present invention to provide a method and/or apparatus for shutting down a fuel burner to prevent damage to the burner in the event the burner's air supply should become blocked.

Yet another object of the present invention is to provide a combustion air proving system that allows an installer to test proper functionality of a burner controller's automatic shut down procedure in the event the burner's air supply should become blocked.

Still another object of the present invention is to provide a controller for monitoring a fuel burner's operation and for further executing automatic shut down and lock out commands in the event a blocked air supply is signaled to the controller.

It is still a further object of the present invention to provide a controller which automatically recycles a fuel burner start up after shutting it down due to a detected blockage in air supply, in an attempt to prevent loss of heat provided to a location should the blockage clear during such recycling procedure.

A further object of the present invention is to provide a latching detent structure that allows for easier, hands-free testing of a fuel burner's operation and response to an air supply being blocked.

Yet another object of the present invention is to provide a flapper assembly for determining whether a sufficient volume of air is being provided to a fuel burner assembly.

Still other objects and advantages of the invention will in part be obvious and will in part be apparent from the specification.

The above and other objects, which will be apparent to those skilled in the art, are achieved in the present invention which is directed to an apparatus for providing heat to a location, comprising a heating system and a controller. The system provides heat to the location, and the controller monitors the system. An air supply conduit for feeding outside air leads to said system, and a sensor is in electrical communication with said controller. The sensor measures a parameter correlating to, or representative of, air flow of said outside air to said system, and communicates said parameter to said controller, wherein said controller monitors said parameter and is responsive to a change in parameter, such that a predetermined threshold initiates a shutdown sequence of said system.

In an embodiment of the apparatus, the sensor is a pressure sensor and the parameter is representative of a pressure level, such that a predetermined pressure level threshold signaled by said pressure sensor initiates the shutdown sequence of said system. The pressure sensor may be capable of measuring low pressure in a near vacuum condition. A damper interchangeable between an open position and a closed position may be further included, said open position allowing said outside air to flow through said air supply conduit to the heating system, and said closed position preventing or impeding air from flowing through said air supply conduit to the heating system. The apparatus may further include an air flow conduit or body attachable to said air supply conduit, said body having an inlet and an outlet for the passage of said outside air flow, said damper disposed within said combustion air proving system body. The inlet may receive the air supply conduit, and the outlet may be connected to the heating system. A pivot rod disposed within said combustion air proving system body may be included, the damper disposed on said pivot rod and rotatable between said open position and said closed position. A damper lever for rotating said damper about said pivot rod between said open position and said closed position may also be provided. The sensor may be an air volume sensor or air temperature sensor.

Another object of the present invention may be directed to a combustion air proving system for monitoring combustion air supplied to a burner, comprising: a body having an inlet and an outlet for the passage of air flow, a sensor disposed on said combustion air proving system body between the inlet and the outlet, the sensor monitoring a parameter correlating to, or representative of, said air flow, and a damper for affecting the air flow monitored by said sensor, the damper further interchangeable between an open position and a closed position, the open position allowing air to flow through said body, and the closed position preventing or impeding air from flowing through said body.

In an embodiment of the combustion air proving system, said sensor is an air pressure sensor or an air flow sensor, and said parameter i s an air pressure level or an air flow level, respectively. The damper may be a planar, rotatable structure within said body, or an iris valve within said body. The damper in the form of said planar, rotatable structure may further be connected to a pivot rod disposed within said body, said damper being rotatable about the pivot rod between said open position and said closed position. Damper actuation may be responsive to a damper lever or damper switch or damper knob. A damper lever attached to an end of said pivot rod for rotating said damper about said pivot rod between said open position and said closed position may further be provided. A latching detent may be disposed on said body, and a lever detent may be disposed on said lever, said latching detent and said lever detent interactive with each other to lock the damper in place once fully rotated to said open position or said closed position. A travel stop may be disposed within said body for preventing over-rotation of said damper within said body between said open position and said closed position. A biasing member for maintaining the damper in the open position may be provided. The biasing member may be selected from the group consisting of: a weight disposed on an edge of the damper, a magnet disposed within said body actively pushing on the damper, a spring exerting a constant force on the damper in a direction towards the open position, and a latch within said body for receiving and locking said damper in place.

Yet another object of the present invention may be directed to a method of testing and monitoring combustion air provided to a burner, comprising: firing a burner, measuring a parameter correlating to, or representative of, an air flowing to the burner via a sensor, sending a signal via the sensor responsive to said parameter measurement to a controller connected to said burner, and shutting down the burner via the controller when a signal from the sensor is determined by the controller to have reached a threshold value.

In an embodiment, the method may further provide an air supply conduit, and further including the step of directing the air from a location away from said burner into said burner via said air supply conduit. The method may further include measuring said parameter within said air supply conduit. The method may also include testing for air flow and sensor operation by preventing or impeding air flow and monitoring said parameter during said testing for air flow and sensor operation. The method may further include starting up the burner via said controller after shutting down, measuring said parameter, determining whether said threshold value is still present, and shutting down the burner via the controller if said threshold value is still present. The method may still further comprise performing three recycling start up attempts, including: repeating starting up said burner at least three additional times after shutting down said burner for the first time, determining whether said threshold value is still present throughout all at least three recycling start up attempts, shutting down the burner via said controller if the threshold value is present, and locking out said burner via the controller if said threshold value is present after all three recycling start up attempts.

Still another object of the present invention may be directed to a combustion air proving kit for monitoring proven combustion air provided to a burner assembly, comprising: a burner, which provides heat to a building, a controller which monitors the burner and is further capable of shutting down the burner when pressure or air flow levels within the burner assembly increase to predetermined unsafe levels, a combustion air proving system having a body, an inlet, and an outlet for air flow, a flapper assembly disposed on the combustion air proving system inlet, the flapper assembly further having a flapper rotatable on its edge between an open position and a closed position via a pivot rod inserted along said edge of the flapper, the flapper assembly further having an actuator disposed on an end of the pivot rod, and a switch electrically connected to the controller and for opening and closing a circuit to the controller, the switch disposed adjacent to and engageable with the actuator, wherein adequate air flow pushes the flapper into the open position, which rotates the pivot rod and actuator so that the actuator engages the switch, wherein upon engaging the switch with the actuator the circuit to the controller is closed, and wherein inadequate air flow allows the flapper to fall into the closed position, which rotates the pivot rod and actuator so that the actuator comes out of engagement with the switch, wherein disengagement of the switch with the actuator opens the circuit to the controller.

Another object of the present invention may be directed to a method of testing and monitoring provided proven combustion air to a power fuel burner, comprising: providing a burner assembly having a burner and a controller, the burner which provides heat to a building, and the controller which monitors the burner and is further capable of shutting down the burner when pressure or air flow levels within the burner assembly increase to predetermined unsafe levels; providing a combustion air proving system having a body, an inlet, and an outlet for air flow; providing a flapper assembly disposed on the combustion air proving system inlet, the flapper assembly further having a flapper rotatable on its edge between an open position and a closed position via a pivot rod inserted along the edge of the flapper, the flapper assembly further having an actuator disposed on an end of the pivot rod; and providing a switch electrically connected to the controller and for opening and closing a circuit to the controller, the switch disposed adjacent to and engageable with the actuator. The steps include firing the burner; rotating the flapper to the open position via adequate air flow; engaging the switch with the actuator upon rotation of the flapper to the open position, thus closing the circuit to the controller; sending a signal from the switch to the controller; and shutting down the burner via the controller upon rotation of the flapper to the closed position due to inadequate air flow, thus disengaging the switch with the actuator and opening the circuit to the controller.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
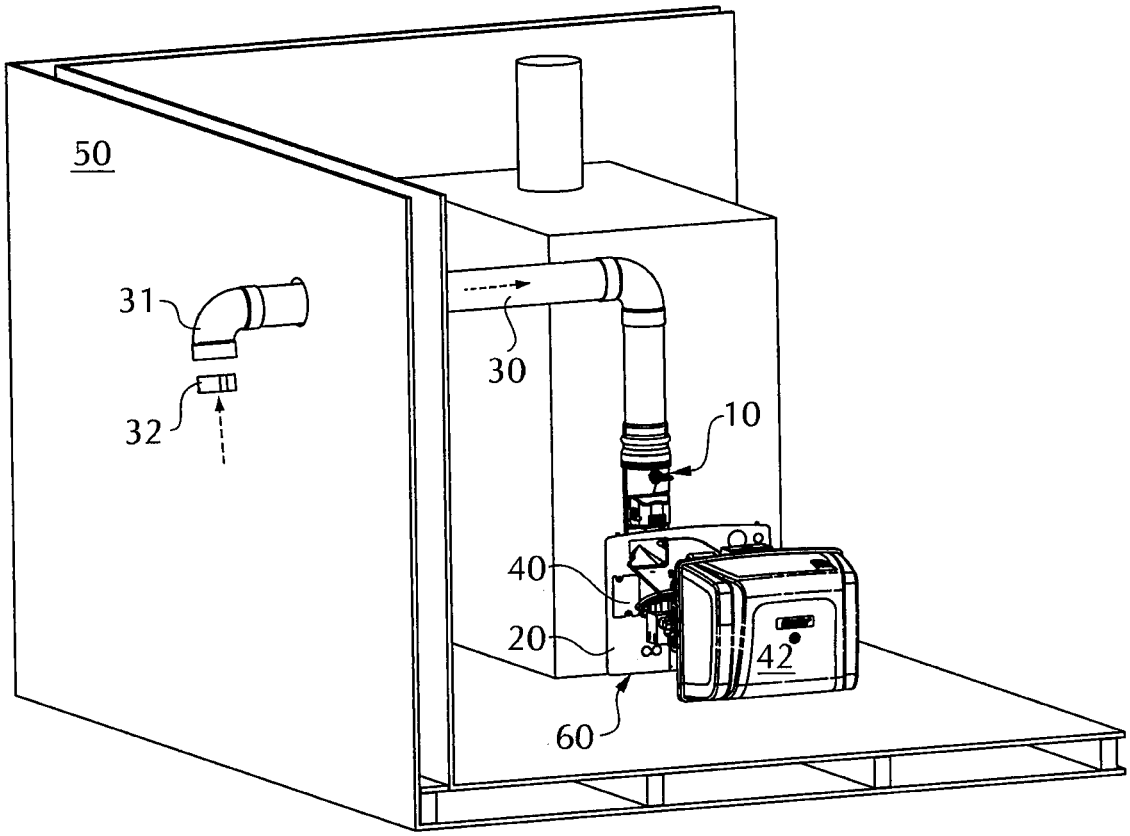
FIG. 1 is a perspective view of a burner assembly of the present invention installed in a location with an air supply pipe installed outside of the location feeding air into the burner.

In describing the embodiment(s) of the present invention, reference will be made herein to FIGS. 1-13 of the drawings in which like numerals refer to like features of the invention. Features of the invention are not necessarily shown to scale.

A combustion air proving ("CAP") system 10 is a means for providing and monitoring proven combustion air to a heating system 40 such as a burner, or other similar power fuel burner structures known in the art (collectively referred to herein as a burner 40). The CAP system 10 is used in conjunction with a burner assembly 60 made up of the burner 40, a back plate 20, and a controller 44, the back plate 20 which provides mounting structures for the CAP system 10. A burner cover 42 restricts the burner's 40 supply of combustion air to only the air that passes through the CAP system 10. The burner assembly 60 may be used in conjunction with a furnace, boiler, water heater, or other like systems meant for providing treated air to a building or location 50.

FIG. 1 depicts a full burner enclosure assembly 60 installed at the building or location 50 employing a first embodiment of the CAP system 10. One end of the CAP system 10 is connected to the burner enclosure assembly 60 through a back plate 20, the features of the CAP system 10 and back plate 20 which will be described in greater detail below. The other end of the CAP system is connected to an airtight externally leading conduit pipe 30, which may be made of polyvinyl chloride ("PVC"), or any other suitable material capable of providing an air-tight conduit from the CAP system to the outside air source. Pipe 30 extends to the outside of the building or location 50 in which the burner assembly 60 is installed, for purposes of drawing air into the burner assembly 60. In the current embodiment shown, a downward facing elbow 31 and a screen 32 are installed on the externally protruding portion of the pipe 30 to prevent blockage of the pipe 30, which may otherwise occur from buildups created by dirt, leaves, snow, animals, etc.

Figure 2:
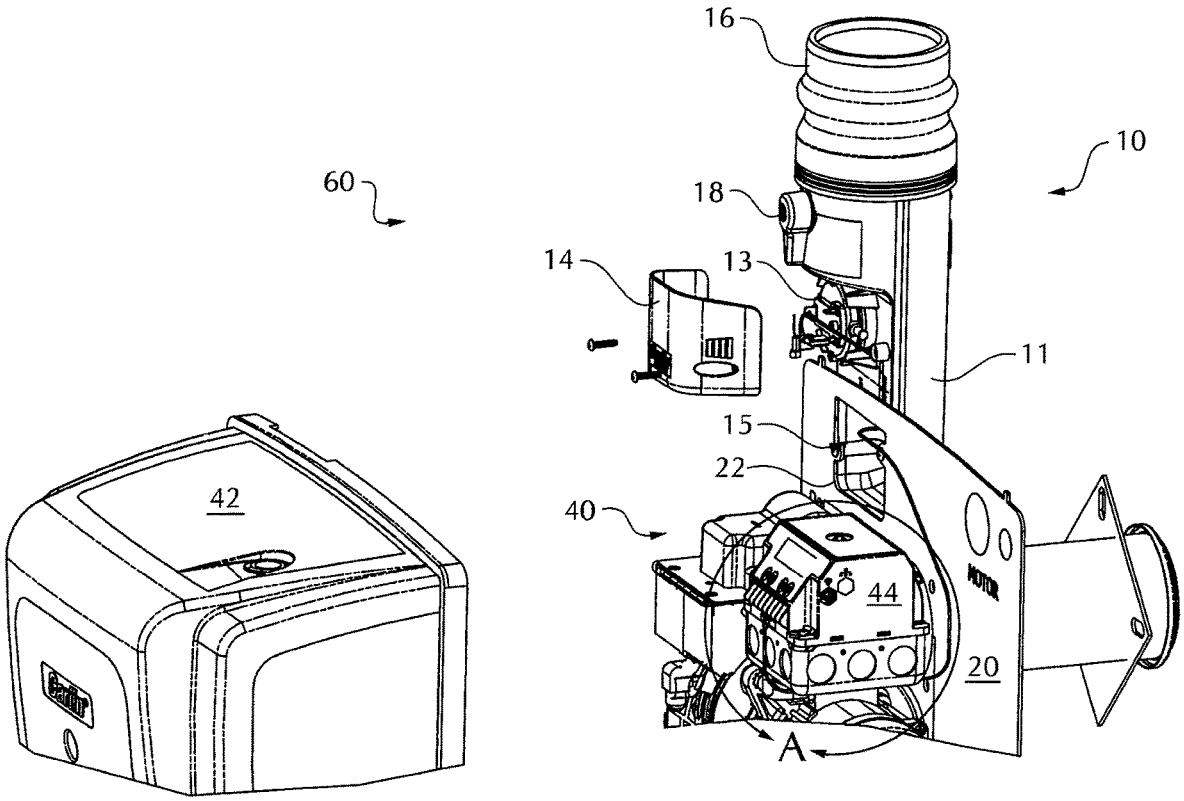
FIG. 2 is a side perspective, exploded view of the burner assembly of FIG. 1.

FIG. 2 presents a more detailed look of the first embodiment of the burner assembly 60 with the connected CAP system 10. The CAP system 10 includes an air outlet 15 ("outlet" with respect to the CAP system; "inlet" with respect to the burner assembly 60) connected to the back plate 20 of the burner assembly through a back plate air outlet opening 22, which allows air flowing in from the external conduit piping 30 to supply the burner 40 with its required air supply. On its visible exterior, the CAP system 10 includes an air flow conduit or body 11, a negative pressure or vacuum sensor 13 (collectively referred to herein as a sensor 13) installed on the front face of the body 11, and an air sensor cover 14 that encases the sensor 13 after installation is complete. Sensor 13 may further be utilized to measure air flow (such as an air flow meter), or temperature (such as a thermocouple), which can be correlated to pressure). Sensor 13 should not be construed as limited to only detecting negative pressure or vacuum conditions, although utilized accordingly in at least one embodiment described herein. In general, the sensor 13 provides an indication of some form for the air supplied to the burner to ensure the CAP system is delivering sufficient air for good combustion.

In the alternative, sensor 13 may be installed anywhere on or within the conduit pipe 30 (not shown), but the effectiveness and accuracy of the CAP system is dependent on how close the sensor 13 is to the burner. For example, a sensor installed outside of the location 50 on the edge of the pipe 30 may be capable of measuring air flow, temperature, or negative pressure conditions corresponding more to the outside portion of pipe 30, but the accuracy of such measurements in the immediate vicinity of the burner itself may be compromised by other conditions created along the length of the pipe traveling through the location to the burner (e.g., a leak in an area of the pipe closer to the burner, for example; or blockage downstream of the sensor). It is therefore preferable to keep the sensor 13 as near the burner as possible (i.e., next to the fan or blower [not shown] which blows the combustion air therein), as the present invention demonstrates.

Controller 44 is programmed to determine whether a predetermined threshold value is met (e.g., negative pressure, vacuum, air flow volume, temperature, etc.) within the conduit 30 or CAP system 10, as measured by sensor 13. If a measured value drops below the threshold, the controller 44 will react to such measurement communicated to it via the sensor 13. Sensor 13 and controller 44 may electrically communicate with each other through either wireless or wired connections, and the present invention is not limited to the type of connection between the sensor and the controller provided signal transmission is not compromised during operation.

Figure 2A:
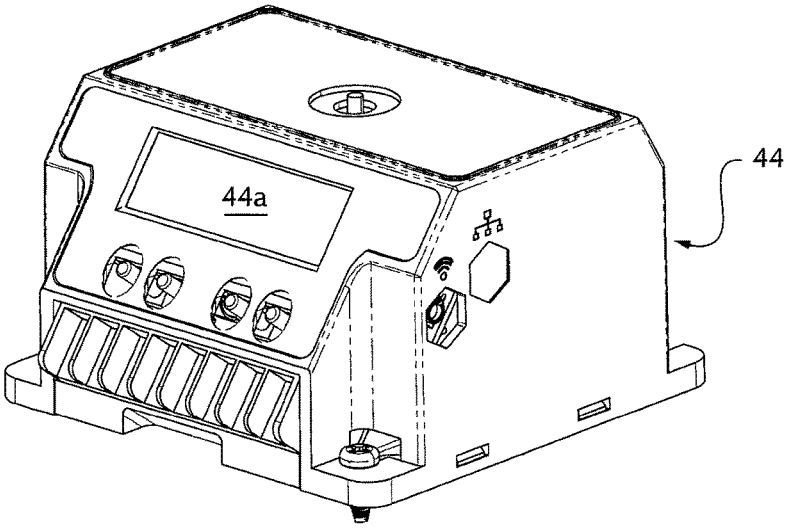
FIG. 2A is a perspective view of the controller of the burner assembly shown within Detail A of FIG. 2.

The CAP system's 10 air proving device is in electrical communication with low voltage blocked vent contacts on the controller 44 (e.g., model 70200 primary safety control of Carlin Combustion Technology, Inc. of North Haven, Conn.), the controller 44 as more clearly shown in FIG. 2A. Controller 44 has a graphical display 44*a* for relaying information to installers pertaining to the controller's functionality and settings. The intake to the CAP system is connected to the airtight PVC conduit piping 30 which extends to the exterior of the building 50.

Figure 2B:
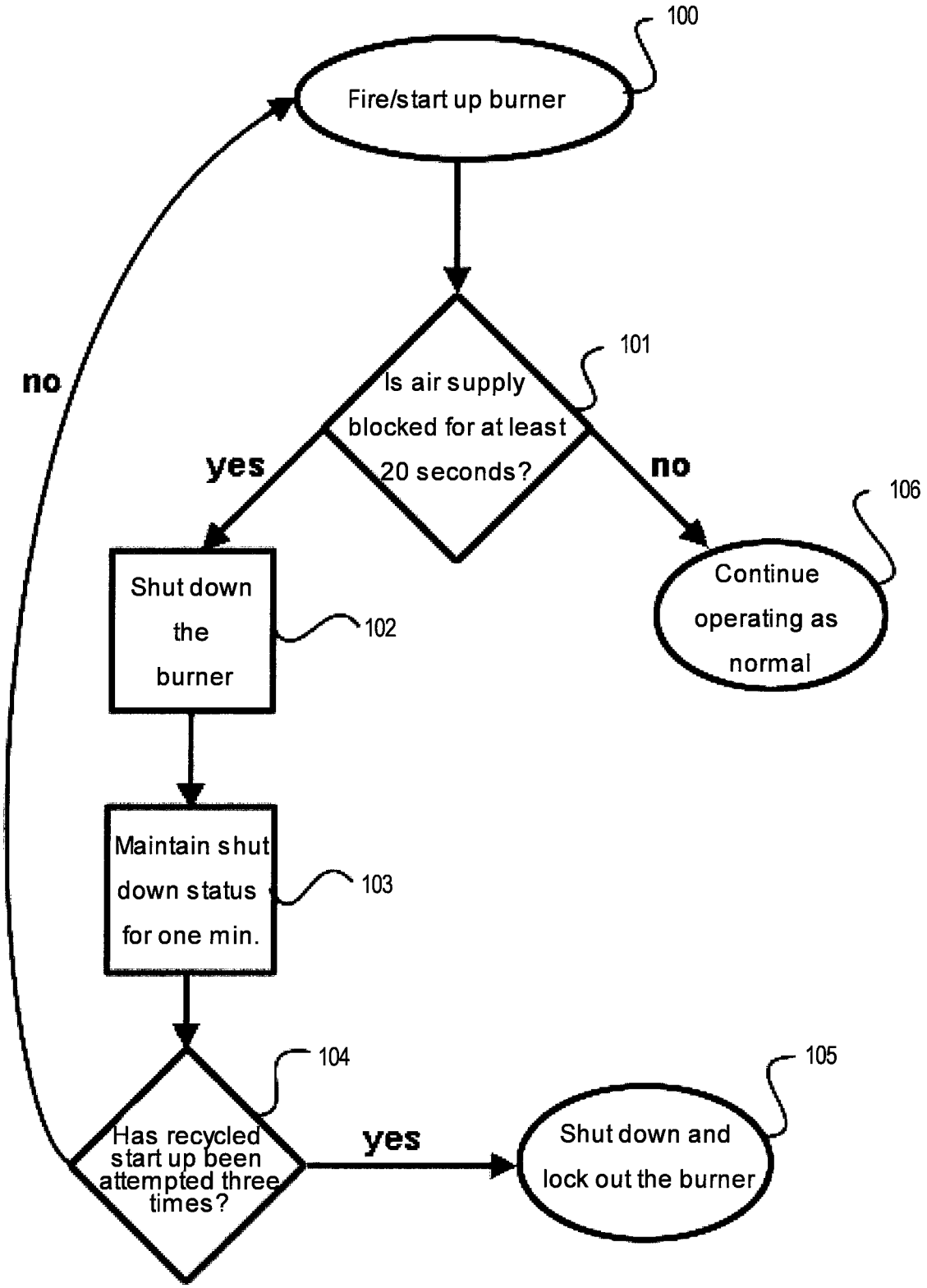
FIG. 2B is a flowchart depicting the steps taken and executed by the controller of FIG. 2A in the event blockage is detected in the air supply of FIG. 1.

Controller 44 is programmed to monitor the burner and shut it down in the event the outside combustion air supply becomes significantly degraded or blocked, as exemplified in the flowchart of FIG. 2B. Whenever the burner 40 is first powered ON (labeled as step 100 in FIG. 2B), the controller 44 will check air intake during a pre-purge stage. If signals are received from the sensor 13 indicating the air intake is blocked (step 101), the controller 44 will execute a command to abort ignition and shut down the burner (step 102). The absence of indicated blockage will allow the burner assembly to continue operating as normal (step 106).

If the air intake is signaled to be open during startup, but later becomes blocked and continues to be blocked for a predetermined period of time chosen as a function of design constraints related to external elements, such as the effects of wind on the intake conduit—alter a predetermined time (such as, for example, approximately twenty seconds during normal operation) (step 101), the controller 44 will execute a command to shut down the burner (step 102). This predetermined time delay is preferable so as to avoid any potential false signaling of blockage. For example, high cross-winds blowing perpendicular to the entry point of air pipe or conduit 30 may temporarily create a negative pressure or vacuum within the conduit for a few seconds. The predetermined time delay thus helps the controller distinguish between a true blockage formed within the conduit 30, or a "false alarm" that would otherwise be created by such temporary events.

After the controller 44 shuts down the burner 40, the controller will execute a recycle command which prompts the burner to recycle the above-described startup sequence (step 104). If blockage still persists, the controller will shut down the burner again as described above (steps 100-102). This recycling command is designed to execute multiple times, e.g., at least three times, between each shutdown (assuming blockage still persists; see step 104), with an approximately one minute delay provided between each recycle attempt (step 103). If the blockage signal relayed by the sensor persists through all three recycle attempts, the controller 44 will execute a final command to shut down and lock out the burner (step 105). A lock out condition is the final safety feature that will require an installer to manually reset the burner assembly and resume normal operations.

Fuel shutoff valves (not shown) are common in burner structures to regulate fuel provided upon startup. With a valve, fuel delivery into the burner is delayed or ceased during the pre-purge stage (step 100). However, in certain installations the burner may lack such a fuel shutoff valve. In these instances, the fuel is provided to the burner immediately upon startup with no delay. Thus, air intake cannot be checked during the pre-purge stage described above. In such valve-less installations, the burner 40 will be shut down by the controller following the twenty second blockage as described above. For all burners included with fuel valves, any valve delay setting of less than a predetermined value (for example, fifteen seconds) will be changed to the predetermined value to allow for the pre-purge test.

The CAP system 10 of the present invention allows an end user/installer to simulate blockage within the pipe 30/CAP system body 11 (as further described below) to ensure the above described steps are properly executed by the controller 44 in the event a true blockage does occur during normal burner operations.

Figure 3:
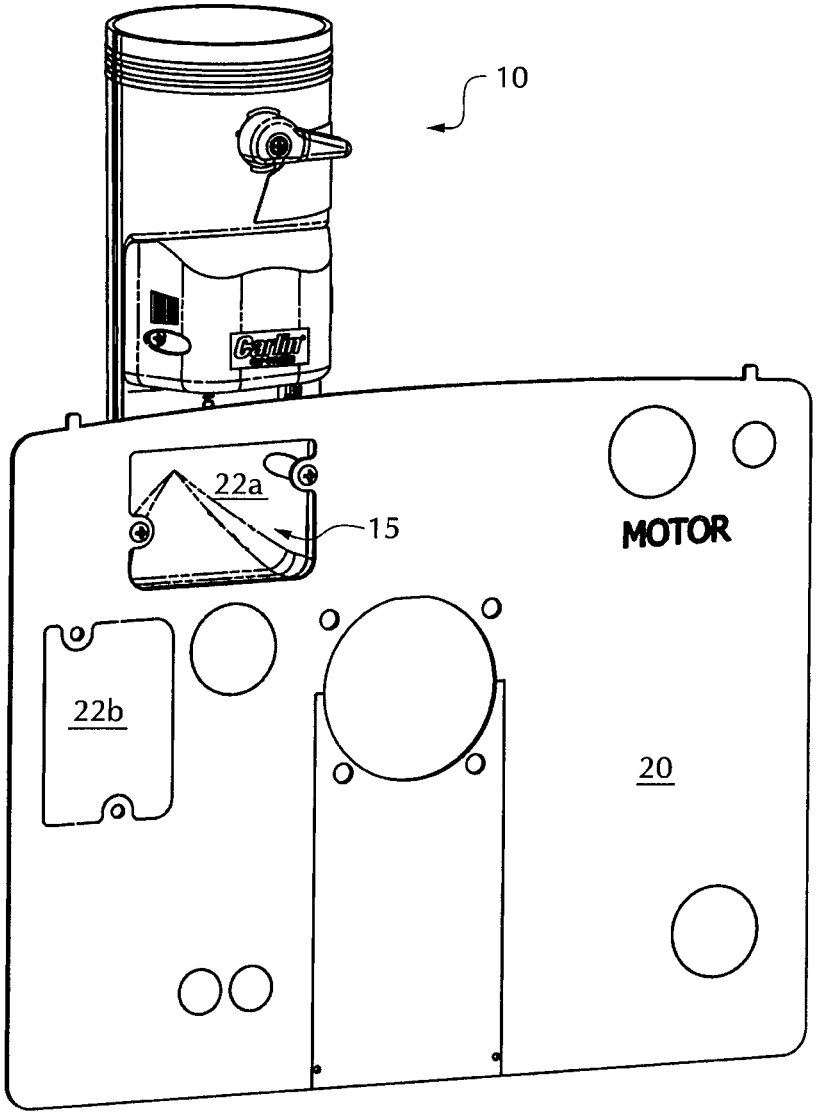
FIG. 3 is a front perspective view of a combustion air proving ("CAP") system of the burner assembly of the present invention installed on a back plate.

FIG. 3 depicts a perspective view of the back plate 20 with the CAP system 10 attached thereto. Back plate openings 22*a*, 22*b* are apertures for receiving and connecting the air outlet 15 of the CAP system 10 to the burner assembly 60, either in a vertical orientation (with respect to opening 22*a* as shown in FIG. 3) or a horizontal orientation (with respect to opening 22*b*), whichever is more practicable during installation. Each opening 22*a*, 22*b* is initially obstructed by a perforated plate that must be removed once the proper opening for installation is determined. The perforated plates that are not removed are meant to assist in preventing any outside air (i.e., not entering from conduit piping 30) from entering the boiler assembly 60 during operation.

Figure 4:
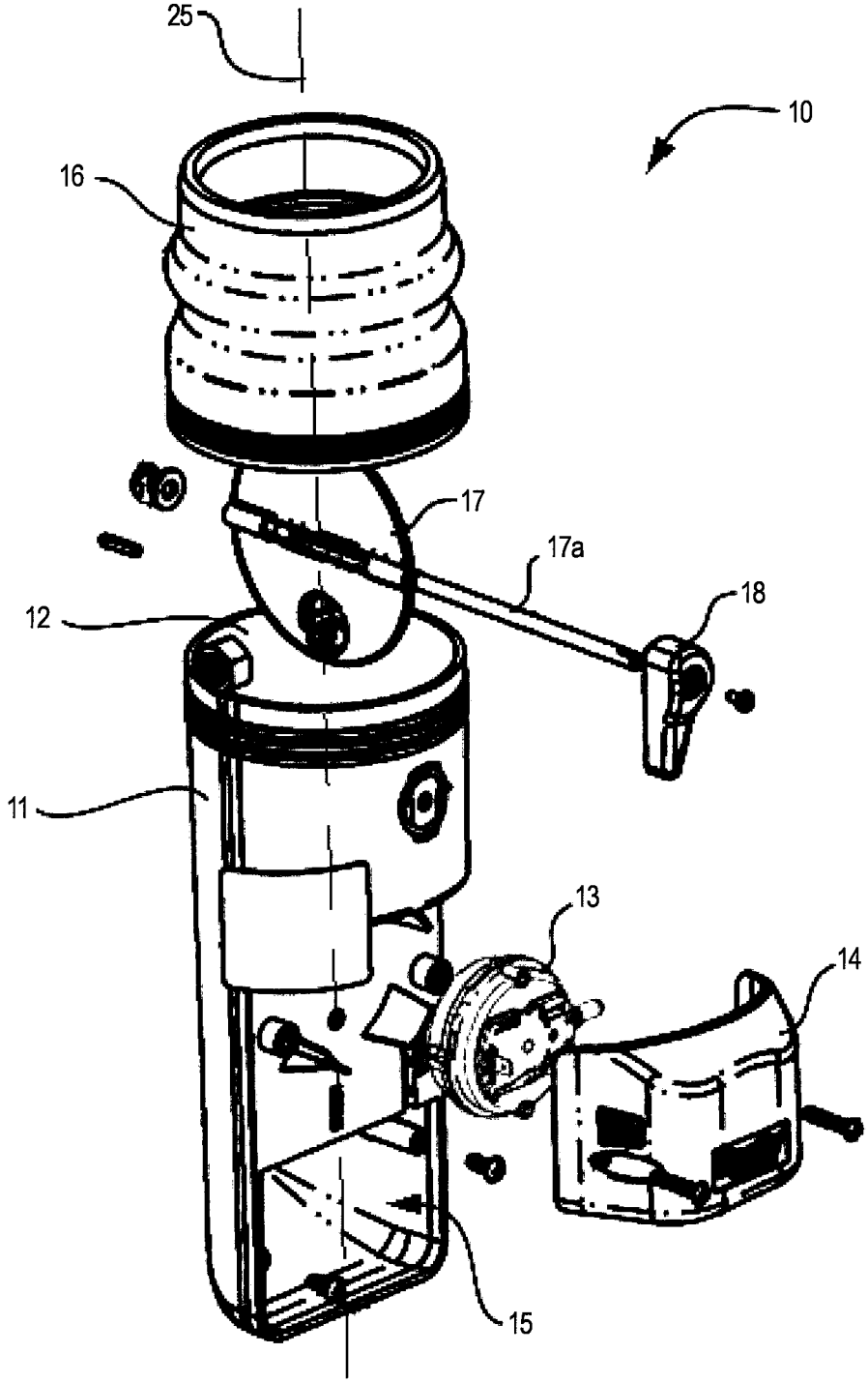
FIG. 4 is an exploded perspective view of the CAP system of FIG. 3 of the present invention.

FIG. 4 depicts an exploded view of the CAP system 10. The body 11 comprises two openings at opposite ends, the first end having an air inlet 12 to receive air flowing from external pipes 30, which attach to connecting flange 16, and the second end having the air outlet 15 for supplying air to burner 40 (not shown). The air sensor 13 is disposed between the two ends of body 11, and may include a sensor cover 14 to encase the air sensor 13 after installation is complete. Connecting flange 16 receives the air inlet 12 on one end, either by threaded fit, adhesive connection, a tight sliding fit, or by any other means of creating an airtight seal between the flange 16 and inlet 12. The other end of the flange 16 receives the end of the external pipes 30, again by threaded fit, adhesive, tight sliding fit, or any other means of creating an airtight seal.

Disposed within the body 11 of the CAP system 10 is damper 17, which functions to block air flow to the burner upon an initialization or test sequence of the system. Damper 17 is depicted in the form of a movable, rotatable disc; however, any type of user operated air blockage construction may be employed. For example, the damper may be in the form of an iris valve, a pneumatic air valve, flow control valve, and the like. The damper may be actuated manually or electrically by a damper lever, a switch, a knob, or the like. In the case of the disc construct, the damper 17 is initially installed to extend vertically within the body 11 of the CAP system 10 parallel to a lengthwise axis 25 of body 11 to allow air to flow into body 11 (See FIGS. 4-6). Damper 17 may be biased open by a biasing member 19 (shown in the figures as a weight on the disc) disposed on an edge of the damper 17 to help drive the damper to an "open" position via gravitational forces in situations where an operator fails to latch the damper into the fully open position. Biasing member 19 may alternatively be the operation of a magnetic system disposed on or within body 11 and/or damper 17 to repel or attract the damper in a direction towards an open position, a spring exerting a constant force on the damper in a direction towards the open position, or a latch within said body for receiving and locking said damper in place, and should not be construed as limited to the weight 19 shown in the drawings. Depending upon the damper construct, moving air may further assist in driving the damper 17 to the "open" position. In the damper embodiment depicted in the figures, damper 17 is connected to pivoting rod 17*a* extending through the damper's central axis, which acts to suspend damper 17 within body 11. Pivoting rod 17*a* protrudes through the front face of the body 11 and is connected at an end opposite damper 17 to damper lever 18, for rotational engagement with the damper 17 after installation. Travel stops 92*a,b* prevent over-rotation of the damper 17 and damper lever 18 during such rotational engagements.

In the first embodiment of the CAP system 10 depicted in FIGS. 4-7, damper lever 18 extends from the front face of the body 11 and is disposed above the sensor 13 and respective cover 14, and is further in mechanical communication with damper 17 through a pivoting, connecting rod 17*a*, as further described below.

Figure 7A:
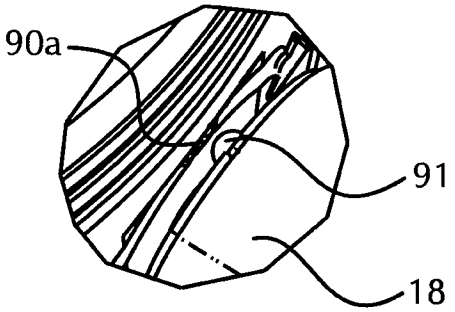
FIG. 7A is a partial perspective view of the latching detent configurations of the CAP system within Detail C of FIG. 7.
Figure 10A:
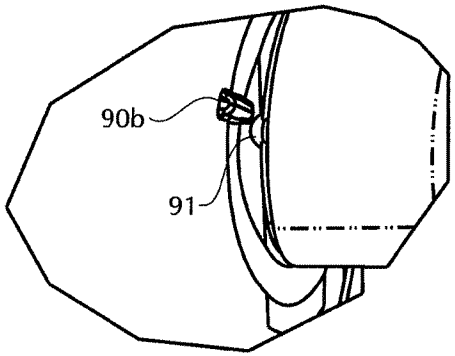
FIG. 10A is a partial perspective view of the latching detent configurations of the CAP system within Detail F of FIG. 10.

Latching detents 90*a*, 90*b* molded into the body 11, and lever detents 91 formed into the damper lever 18, are positioned to hold the damper 17 in the test/run (or closed/open, respectively) positions after rotation of the lever 18 to either of such position, as best shown in FIGS. 7A and 10A. Detent 90*a* is a slight groove or recession on the outside surface of the CAP system body 11 for receiving lever detent 91 upon the lever 18 full rotation into the "open" or "run" position. Detent 90*b* is a slight protrusion, flange, fin, or bump extending from the outside surface of the CAP system body 11, and lever detent 91 is a complimentary protrusion, flange, fin, or bump extending from the lever 18 in a direction towards the body 11. Detent 90*b* protrudes a far enough distance from the body 11 surface to contact lever detent 91 upon lever 18's full rotation into the "closed" or "test" position, and upon such initial contact, requires an end user to exert some rotational force on lever 18 to rotate detent 91 past latching detent 90*b* such that detent 91 slides over latching detent 90*b*. Lever 18 (and corresponding damper 17) can be rotated out of the "closed" or "test" position by rotating the lever 18 in the opposite direction, ensuring enough force is exerted by an end user to push lever detent 91 back over latching detent 90*b*. This configuration is designed to provide sufficient resiliency to allow the damper to be inserted and removed from the detents.

Detents 90*a,b*, 91 will allow an installer to test the functions of the present invention without the need to hold the damper lever 18 in place for the duration of the delay time (approximately twenty seconds, as described above) needed to execute the shut down and lock out commands performed by the controller 44. These detents further provide a "snap in" feel for the installer to indicate the device being fully placed and held in the test/run positions.

Figure 7B:
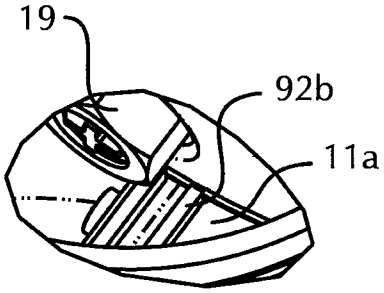
FIG. 7B is a partial perspective view of the travel stop configuration of the CAP system within Detail D of FIG. 7.
Figure 7:
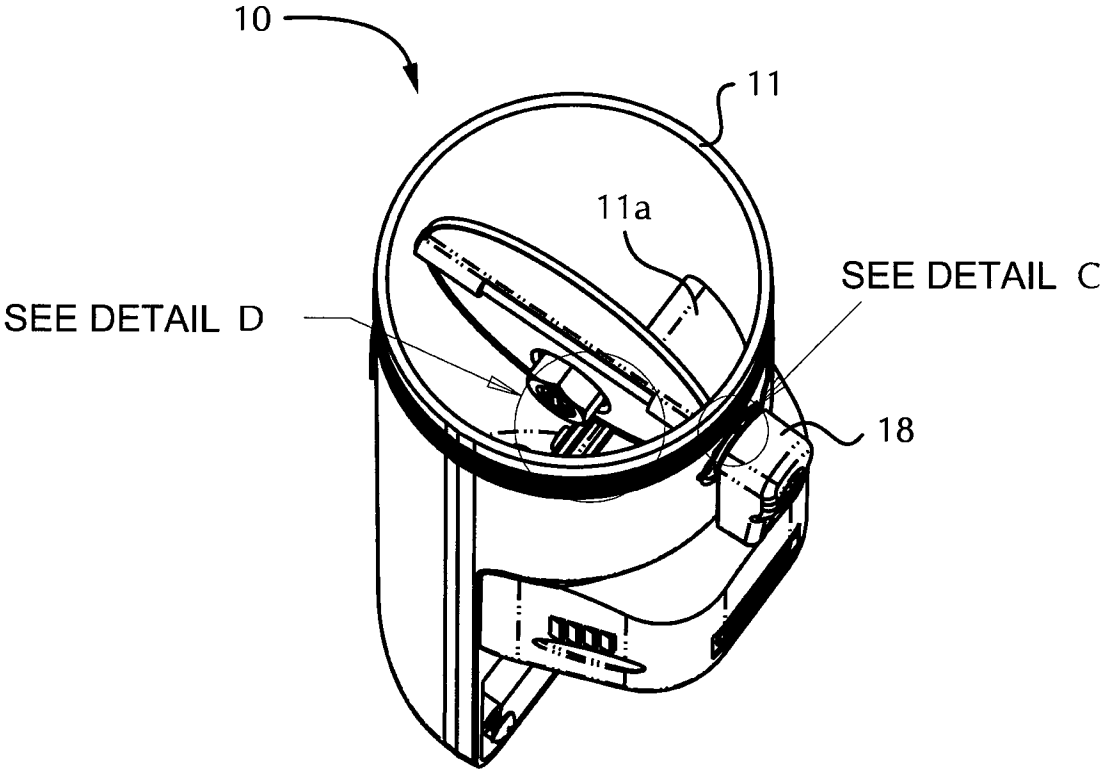
FIG. 7 is a top-down perspective view of the CAP system in the "open" or "run" position as in FIG. 5.
Figure 9:
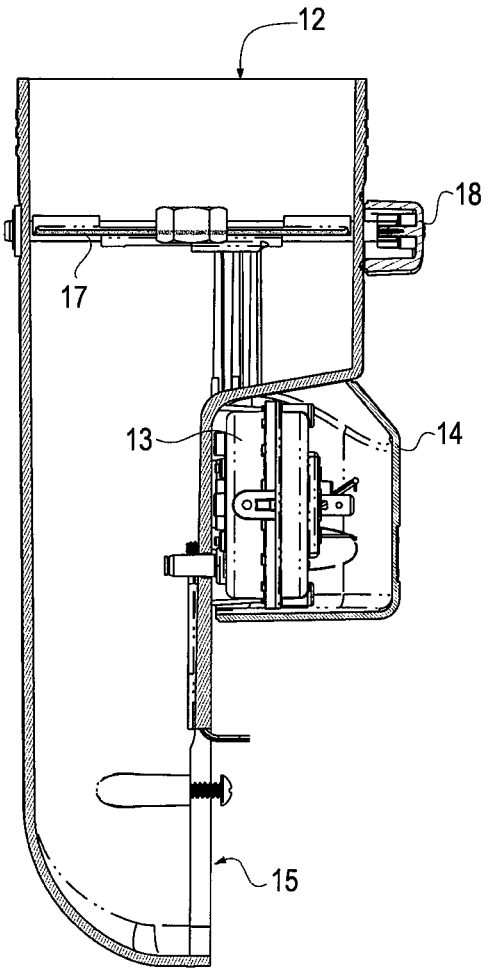
FIG. 9 is a side cross-sectional view of the CAP system viewed along Section E-E of FIG. 8.
Figure 10B:
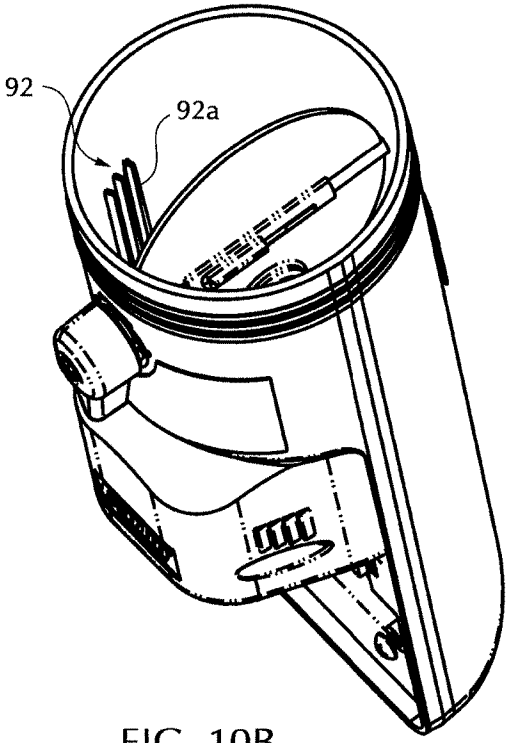
FIG. 10B is a top-down perspective view of the CAP system of FIG. 3 with the damper in the "open" or "run" position so as to show the travel stop configuration for contacting the damper when the damper is rotated into the "closed" or "test" position.
Figure 10:
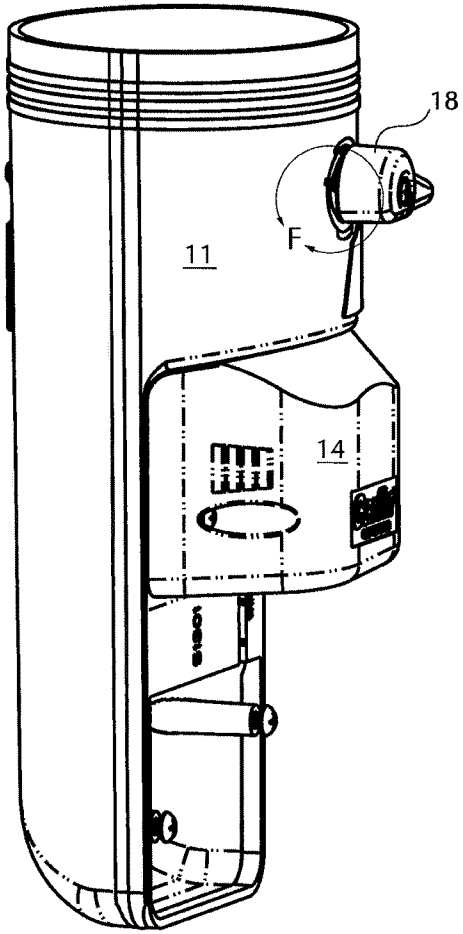
FIG. 10 is a side perspective view of the CAP system in the "closed" or "test" position as in FIG. 8.

A travel stop 92 is further disposed within the body 11 of the CAP system 10 having two portions, a first portion of the travel stop 92*a* running alongside the inner wall of the body 11 as best shown in FIG. 10B, and a second portion of the travel stop 92*b* running across the inner width of the body 11 protruding from a shelf 11*a* formed within said body 11 as best shown in FIG. 7B. Travel stop 92*a* is formed by at least one rail (and optionally a plurality of rails as shown in FIGS. 9 and 10B) protruding from the inside surface of the body and running along the surface in a longitudinal direction. Travel stop 92*b* is similarly formed by at least one rail (and optionally a plurality of rails, as shown in FIGS. 7 and 7B) extending partially across the shelf 11*a* of body 11. When the damper 17 is rotated into the closed position, the travel stop first portion 92*a* will prevent the damper from over-rotation past the closed position and hold it at a substantially 180° angle, in conjunction with the latching detents 90*b*, 91 holding the damper closed. When the damper is rotated into the open position, the travel stop second portion 92*b* prevents over-rotation of the damper past the open position and holds it at a substantially 90° angle, in conjunction with the latching detents 90*a*, 91 holding the damper open. It should be noted, however, that the travel stop is an optional design construct, as the damper may be fully rotational about rod 17*a*, with only the detents providing a stopping point.

Figure 5:
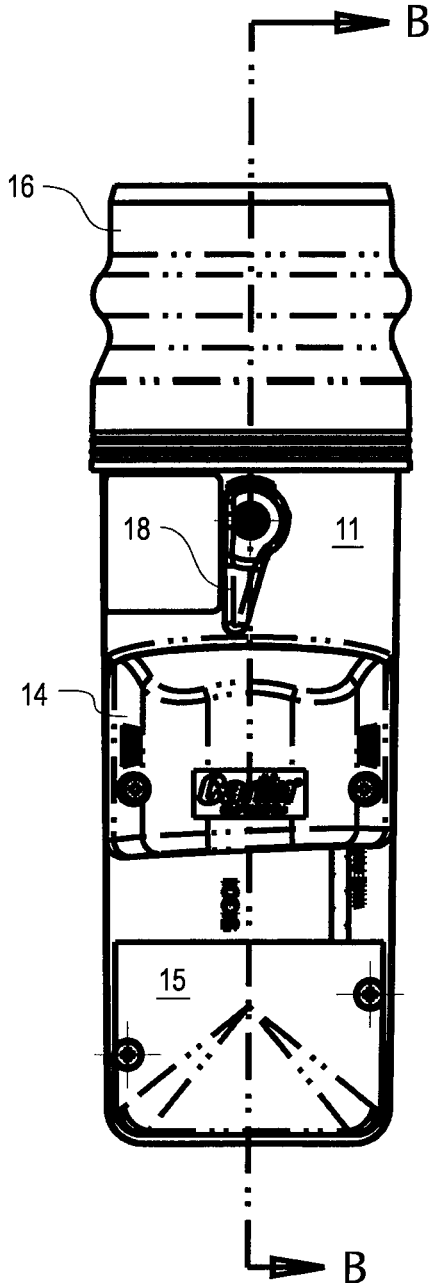
FIG. 5 is a front elevational view of the CAP system of FIG. 3 with a damper disposed in the "open" or "run" position.
Figure 6:
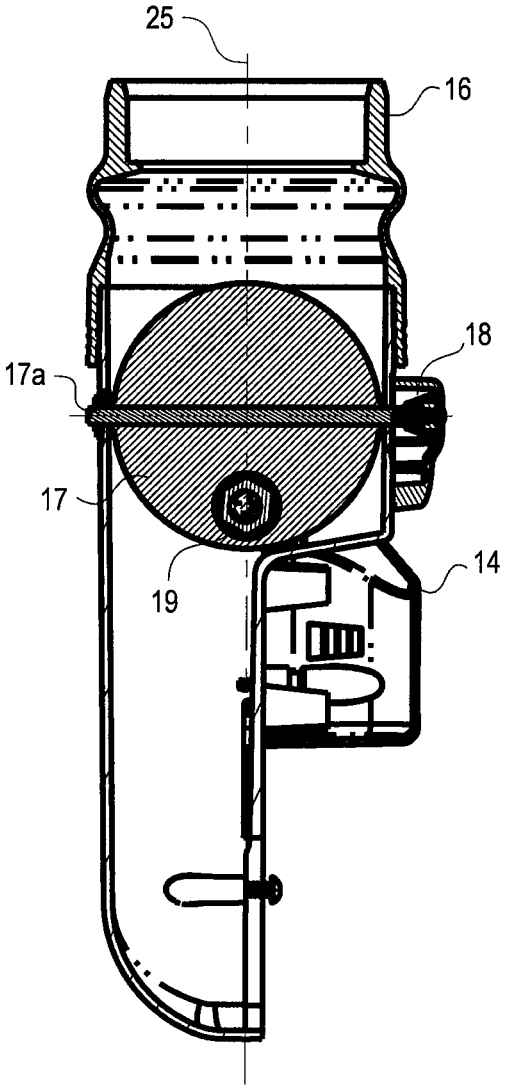
FIG. 6 is a side cross-sectional view of the CAP system viewed along Section B-B of FIG. 5.

When the damper 17 is in the "open" position (i.e., allowing air flow to traverse from an outside air supply, through conduit piping 30, and into the body 11), the damper lever 18 points in a predetermined direction, here shown to be downwards along a vertical axis (see FIG. 5). In the case of a different damper construct, such as an iris valve, a lever may be utilized to open and close the iris aperture. In the embodiment depicted in the figures, lever 18 and damper 17 are held in the "open" position via the latching detents 90*a*, 91, as shown in FIGS. 5-7.

Figure 8:
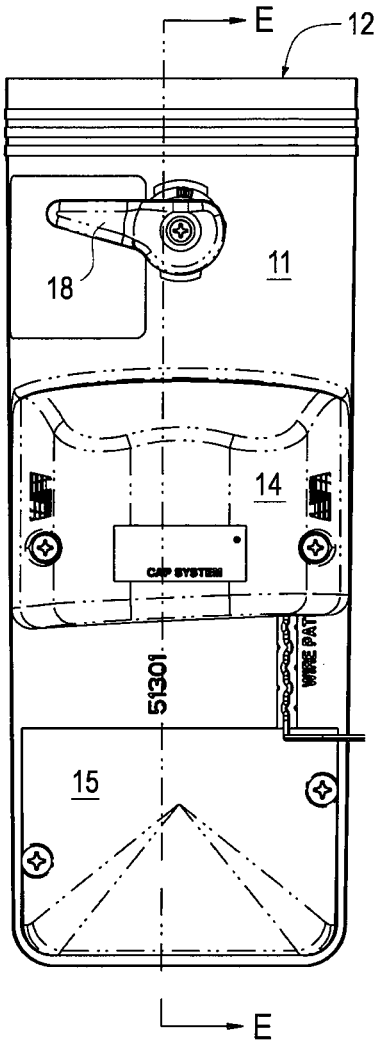
FIG. 8 is a front elevational view of the CAP system of FIG. 3 with the damper disposed in the "closed" or "test" position.

The damper lever 18 points in the same direction as the plane of the damper disc, giving a user the ability to ascertain the position of the damper without visibly seeing the damper. When the damper 17 is in the "closed" position (i.e., preventing air flow from entering the burner assembly 60), the damper lever 18 points in the same direction as the plan of the damper disc—along the vertical axis 25. When the damper is in the open" position, the damper lever points along the horizontal axis, perpendicular to the vertical axis 25 as depicted in FIGS. 8-9. For purposes of this invention, the damper lever 18 may be oriented at any preferred angle h respect to its axis, and is not limited to the angle shown in FIGS. 5-9.

The first embodiment of the CAP system 10 relies upon detecting a near-vacuum condition (extremely low pressure condition or absence of air flow in the conduit) before shutting burner 40 down. This low pressure condition may be caused by an obstruction in the air supply conduit, such as within the vent conduit piping 30, or alternatively, a high wind condition where the conduit piping 30 is exposed to the outside environment and high cross-winds cause low pressure and low air flow in the conduit. As air is drawn into the sealed burner cover 42 by the burner fan, a pressure drop may be detected based, in part, on the firing rate of the burner, indicating a lack of sufficient combustion air flow, which can lead to unsafe conditions. Sensor 13 will sense this lack of air flow and either send a signal to the controller or directly act to open a set of normally closed contacts (acting as a go/no-go switch), which in turn opens the electrical circuit to prevent burner 40 from continuing its operation. In another embodiment, the sensor 13 may communicate the low pressure/low air flow level to be received by, stored in, and/or displayed on the controller 44, in order for the controller 44 to react to certain pressure/air flow levels based upon the controller's 44 programming interface. After a period of time (such time threshold being pre-deter mined and programmed into the controller) and based upon the signals received by sensor 13, the controller 44 shuts the burner down resulting in the burner reverting back into a startup sequence, or conversely a shutdown sequence, until it is manually reset (also referred to as the "lock out" condition, as previously described). The controller 44 may further monitor the burner's 40 flame detector to ensure it is still lit during operation.

In order to monitor the effectiveness of this system, damper 17 is provided to simulate blockage in the vent conduit piping 30. This allows for technicians to verify proper reaction of the controller 44 to blockage situations.

Damper 17 may be installed anywhere along air intake pipe 30, and is not physically limited to the body 11 of the CAP system. However, it is preferred to keep the damper 17 at least within the walls of location 50 (instead of outside), and close to the burner assembly 60, as this is more convenient to an installer who will use the damper and CAP system to test proper functionality of the burner assembly. The damper 17 may also alternatively be formed into any solid piece capable of at least partially blocking the intake conduit 30, and is not limited to the rotatable damper 17 plate shown in the drawings herein. For example, damper 17 may be a slide gate that can be pushed into a slot formed on the pipe, an iris valve, or any other air blocking structure. These dampers may further be electronically interactive (e.g., pushing a button or hitting a switch opens/closes the damper) instead of manually interactive. An installer may even use their own hand or a solid sheet of material to temporarily block the conduit 30, in which case, a damper structure is removed from the CAP system design.

Figure 11:
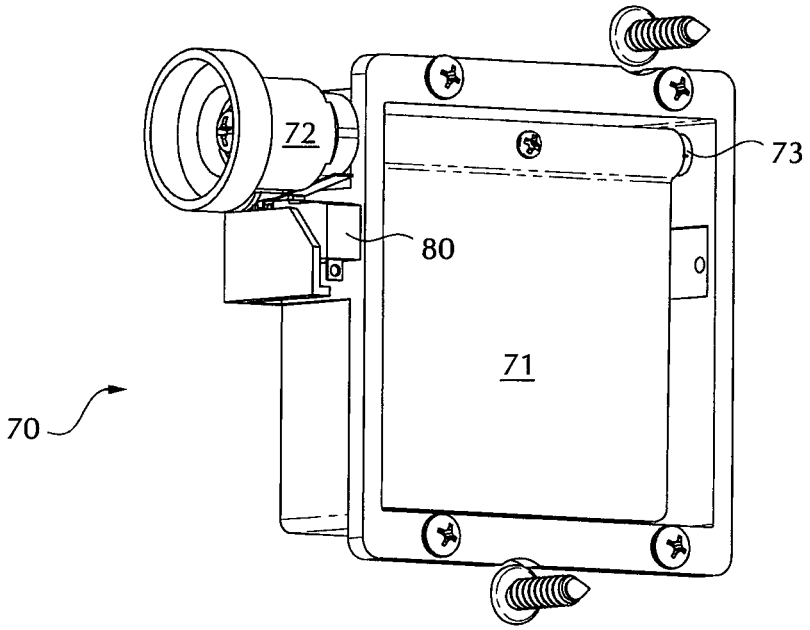
FIG. 11 is a side perspective view of a flapper assembly for installation on the back plate of FIG. 3 of the present invention.
Figure 12:
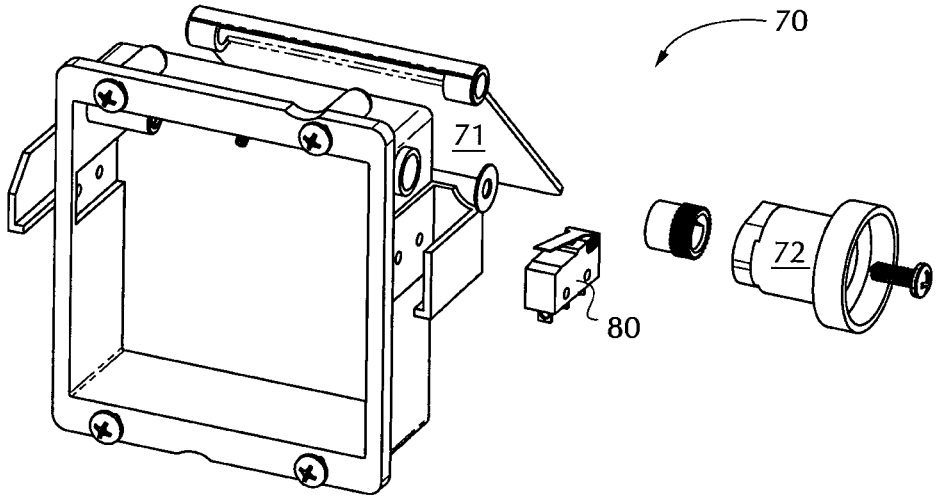
FIG. 12 is a side, exploded, perspective view of the flapper assembly of FIG. 11.
Figure 13:
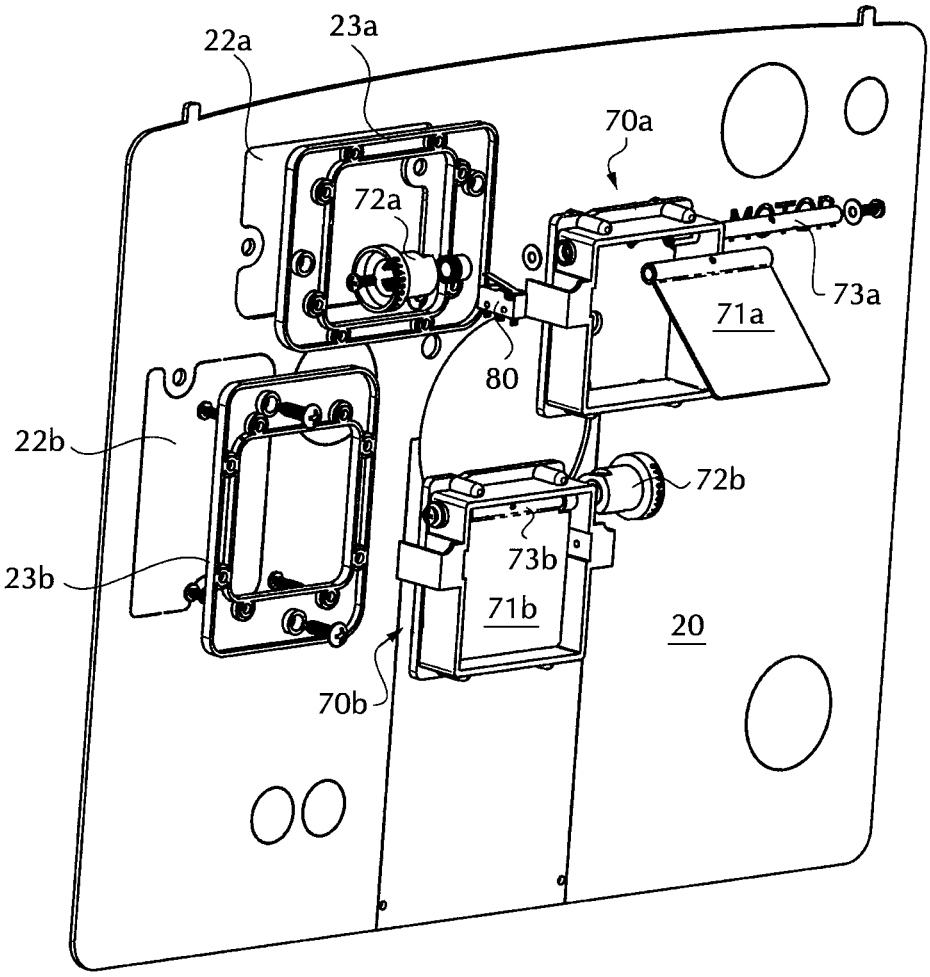
FIG. 13 is a side, exploded, perspective view of the back plate of FIG. 3 with multiple flapper assembly embodiments installed thereon.

An alternate embodiment of the CAP system 10 relies on sensing a decrease in combustion air volume at the burner intake. Referring to FIGS. 11-13, a flapper 71 is initially held closed by a combination of gravity and lack of airflow. An actuator 72*a,b* (e.g., a cam, knob, lever, or any other applicable actuating device) connected to a flapper pivot rod 73 is adjusted so that the actuator 72 engages a switch 80 (which may include, but not be limited to, any type of switch that is capable of opening or closing an electrical circuit, e.g., a micro switch, sail switch, reed switch, toggle switch, reversing switch, and the like). Actuator 72 initiates the switch 80 contacts to close, completing the electrical circuit, when air volume for a particular firing rate of burner 40 is unrestricted, as forces from such air volume rotate actuator 72*a,b* via the respective flapper 71*a,b* rotatable by respective rod 73*a,b*, into engagement with the switch 80. Blockage in the conduit piping 30 reduces the volume of air flow resulting in the flapper 71 moving closer to a closed position which tends to block the intake opening, thereby disengaging actuator 72 from the switch 80, and thus opening the switch 80 contacts. The controller 44 reacts in a manner similar to how it reacts upon receiving like-signals from the sensor 13 (as previously described above). The system in this embodiment is tested by fully blocking either the back plate opening 22 where the vent conduit piping 30 feeds, or at a location in the piping, such as the piping elbow 31 at the exterior of the building, thereby creating no air flow.

FIG. 13 depicts an exploded view of the back plate 20 with the flapper assembly embodiment installed. Back plate openings 22*a*, 22*b* are apertures for receiving and connecting a flapper assembly 70*a*, 70*b*, referred to collectively as 70, having flapper 71*a*, 71*b*, respectively, to the burner assembly 60, either in a vertical orientation (with respect to opening 22*a*) or a horizontal orientation (with respect to opening 22*b*), whichever is more practicable during installation. Plates 23*a*, 23*b* conform respectively to openings 22*a*, 22*b* to ensure an air-tight seal is created between the conduit piping 30, back plate openings 22*a*, 22*b*, and flapper assembly 70*a*, 70*b* upon installation. Each opening 22*a*, 22*b* is initially obstructed by a perforated plate that must be removed once the proper opening for installation is determined. The perforated plates that are not removed during operation are meant to assist in preventing any outside air (i.e., not entering from conduit piping 30) from entering the boiler assembly 60.

Sequence of Installation/Operation (Preset Sensor Embodiment):

The CAP system 10 is mounted to the burner cover back plate 20.

The preset sensor 13, factory set at the correct negative pressure threshold for the burner 40 firing rate, is installed onto the body 11 of the CAP system 10 near the air inlet 12.

One end of the wiring harness is connected to the sensor contacts. The other end is connected to the low voltage Blocked Vent contacts on the controller 44.

Sensor cover 14 is installed.

PVC conduit piping 30 starting at the connecting flange 16 is run to the outside of the building 50 and fitted with a downward facing elbow 31 with screen 32.

The damper 17 is positioned in the RUN (open) position.

With the burner cover 42 temporarily removed, the burner 40 is adjusted to recommended settings after which the burner cover 42 is reinstalled.

The burner is fired and the unblocked vent pipe 30 results in a negative pressure level beneath that of the sensor 13 setting leaving the controller's 44 Blocked Vent switch contacts closed (indicating 'not blocked').

Sequence of Installation/Operation (Adjustable Sensor Embodiment):

The CAP system 10 is mounted to the burner cover back plate 20.

The adjustable sensor 13 is installed onto the body 11 of the CAP system 10 near the air inlet 12. The installer will dictate the correct negative pressure threshold for the burner 40 firing rate.

One end of the wiring harness is connected to the sensor 13 contacts. The other end is connected to the low voltage Blocked Vent contacts on the controller 44.

PVC conduit piping starting at the flexible adapter is run to the outside and fitted with a downward facing elbow 31 with screen 32.

With the burner cover 42 temporarily removed, burner 40 is adjusted to recommended settings after which the burner cover 42 is reinstalled.

The test damper 17 is positioned in the RUN (open) position.

At the first burner startup the sensor 13 adjustment screw is turned until the switch contacts close (normal, low vacuum condition).

Sensor cover 14 is installed.

The burner 40 is fired and the unblocked vent pipe 30 results in a vacuum level beneath that of the switch leaving the controller's 44 Blocked Vent switch contacts closed (indicating 'not blocked').

Sequence of Installation/Operation (Air Volume Sensing Embodiment):

The CAP system 10 is mounted to the burner cover back plate 20.

The flapper actuator 72 is adjusted to the burner 40 firing rate setting.

With the flapper 71 temporarily locked in the horizontal (open) position and the burner cover 42 removed, the burner 40 is adjusted to recommended settings after which the flapper 71 is removed from the horizontal position and the burner cover 42 is reinstalled.

The burner 40 is fired and the unblocked vent pipe 30 provides an air volume adequate to force the flapper 71 open enough to actuate the switch 80 providing the contact closure at the controller's 44 Blocked Vent switch contacts (indicating 'not blocked').

Thus, the present invention provides one or more of the following advantages: 1) a burner assembly having a combustion air proving ("CAP") system that assists technicians in determining whether a burner's shutoff functions (e.g., via a controller) work properly when the burner is subjected to a reduction in air supply; and 2) a burner assembly having a CAP system and further including a flapper assembly that opens and closes a circuit in communication with a controller to provide the controller a signal as to whether inadequate air flow is traversing through the burner assembly, thus launching a shutdown sequence.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for heating air provided to a location, comprising:

an air heating system and a controller, said system providing heated air to said location, and said controller monitoring said system;

an air supply conduit feeding outside air to said system;

a combustion air proving (CAP) system including a sensor in electrical communication with said controller, said sensor measuring a parameter correlating to, or representative of, air flow of said outside air to said system, and communicating said parameter to said controller, wherein said controller monitors said parameter and is responsive to a change in parameter, such that a predetermined threshold initiates a shutdown sequence of said system; and a back plate providing mounting structure for said CAP system including at least one obstructed aperture with a removable obstruction for receiving and connecting an air outlet of the CAP system to said air heating system, wherein said at least one obstruction is removed once an opening for installation is determined, and obstructions not removed remain in place to assist in preventing any outside air from entering the air heating system during operation.

2. The apparatus of claim 1 wherein the sensor is a pressure sensor and the parameter is representative of a pressure level, such that a predetermined pressure level threshold signaled by said pressure sensor initiates the shutdown sequence of said system.

3. The apparatus of claim 2 wherein the pressure sensor is capable of measuring low pressure in a near vacuum condition.

4. The apparatus of claim 1 further including a damper interchangeable between an open position and a closed position, said open position allowing said outside air to flow through said air supply conduit to said air heating system, and said closed position preventing or impeding air from flowing through said air supply conduit to said air heating system.

5. The apparatus of claim 4 further including an air flow conduit or body attachable to said air supply conduit, said body includes an inlet and an outlet for the passage of said outside air flow, said damper disposed within said combustion air proving system body.

6. The apparatus of claim 5 wherein said inlet receives the air supply conduit, and said outlet is connected to said air heating system.

7. The apparatus of claim 6 further including a pivot rod disposed within said combustion air proving system body, the damper disposed on said pivot rod and rotatable between said open position and said closed position.

8. The apparatus of claim 7 further including a damper lever for rotating said damper about said pivot rod between said open position and said closed position.

9. The apparatus of claim 1 wherein the sensor is an air volume sensor or air temperature sensor.

10. The apparatus of claim 1 wherein said heating system is a burner.

11. The apparatus of claim 1 including a flapper connected to an actuator via a pivot rod, said flapper rotatable to block an intake of said air heating system, said actuator adjusted such that a switch is engaged completing an electrical circuit when said sensor measures a decrease in combustion air volume at said intake of said air heating system; said combustion air volume for a particular firing rate of said air heating system being unrestricted as forces from said combustion air volume rotate said actuator via said flapper and pivot rod into engagement with said switch.

12. The apparatus of claim 11 wherein said flapper rotates closer to a closed position when said air supply conduit has blockage that reduces combustion air volume, thereby disengaging said actuator from said switch, and thus opening electrical contacts of said switch.

13. A combustion air proving system for monitoring combustion air supplied to a burner, comprising:

a body having an inlet and an outlet for the passage of air flow;

a sensor disposed on said combustion air proving system body between the inlet and the outlet, the sensor monitoring a parameter correlating to, or representative of, said air flow; and a damper for affecting the air flow monitored by said sensor, the damper further interchangeable between an open position and a closed position, the open position allowing air to flow through said body, and the closed position preventing or impeding air from flowing through said body, wherein said damper is a planar, rotatable structure connected to a pivot rod disposed within said body, said damper being rotatable about the pivot rod between said open position and said closed position.

14. The combustion air proving system of claim 13 wherein said sensor is an air pressure sensor or an air flow sensor, and said parameter is an air pressure level or an air flow level, respectively.

15. The combustion air proving system of claim 13 wherein said damper actuation is responsive to a damper lever or damper switch or damper knob.

16. The combustion air proving system of claim 15 further including said damper lever attached to an end of said pivot rod for rotating said damper about said pivot rod between said open position and said closed position.

17. The combustion air proving system of claim 16 further including a latching detent disposed on said body, and a lever detent disposed on said lever, said latching detent and said lever detent interactive with each other to lock the damper in place once fully rotated to said open position or said closed position.

18. The combustion air proving system of claim 16 further including a travel stop disposed within said body for preventing over-rotation of said damper within said body between said open position and said closed position.

19. The combustion air proving system of claim 13 further including a biasing member for maintaining the damper in the open position.

20. The combustion air proving system of claim 19 wherein said biasing member is selected from the group consisting of: a weight disposed on an edge of the damper, a magnet disposed within said body actively pushing on the damper, a spring exerting a constant force on the damper in a direction towards the open position, and a latch within said body for receiving and locking said damper in place.

21. The apparatus of claim 13 including a flapper connected to an actuator via a pivot rod, said flapper rotatable to block an intake of said air heating system, said actuator adjusted such that a switch is engaged completing an electrical circuit when said sensor measures a decrease in combustion air volume at said intake of said air heating system; said combustion air volume for a particular firing rate of said air heating system being unrestricted as forces from said combustion air volume rotate said actuator via said flapper and pivot rod into engagement with said switch.

22. The apparatus of claim 21 wherein said flapper rotates closer to a closed position when said air supply conduit has blockage that reduces combustion air volume, thereby disengaging said actuator from said switch, and thus opening electrical contacts of said switch.

* * * * *